United States Patent [19]

Mayr

[11] Patent Number: 5,016,901

[45] Date of Patent: May 21, 1991

[54] SKI

[75] Inventor: Bernhard Mayr, Hard, Austria

[73] Assignee: TMC Corporation, Baar/Zug, Switzerland

[21] Appl. No.: 380,610

[22] Filed: Jul. 17, 1989

[30] Foreign Application Priority Data

Aug. 11, 1988 [AT] Austria ..... 2022/88
Feb. 17, 1989 [AT] Austria ..... 370/89

[51] Int. Cl.[5] ..... A63C 5/04

[52] U.S. Cl. ..... 280/607; 280/610; 280/633

[58] Field of Search ..... 280/610, 607, 611, 617, 280/636, 633

[56] References Cited

U.S. PATENT DOCUMENTS 3,628,802 12/1971 Hashimoto et al. ..... 280/610
3,738,675 6/1973 Hashimoto ..... 280/610

FOREIGN PATENT DOCUMENTS 288932 3/1971 Austria .
586946 10/1933 Fed. Rep. of Germany .
3705507 9/1987 Fed. Rep. of Germany ..... 280/601
575768 2/1974 Switzerland .

*Primary Examiner*—David M. Mitchell
*Attorney, Agent, or Firm*—Finnegan, Henderson, Farabow, Garrett & Dunner

[57] ABSTRACT

The invention comprises a ski having at least one lower cover, at least one upper cover, a core disposed between the upper cover and the lower cover, the core including recessed grooves in a side thereof proximate the upper cover and strip-shaped receiving parts disposed in the grooves. The receiving parts include at least two layers, one of the two layers including metal, and the other of the at least two layers including an elastomeric material, and spacer sleeves extending through the elastomeric material layer and including distal ends which extend beyond the upper cover. The distal ends are for bearing a base plate thereon and the spacer sleeves are for receiving fastening screws to connect the base plate with the receiving parts.

17 Claims, 4 Drawing Sheets

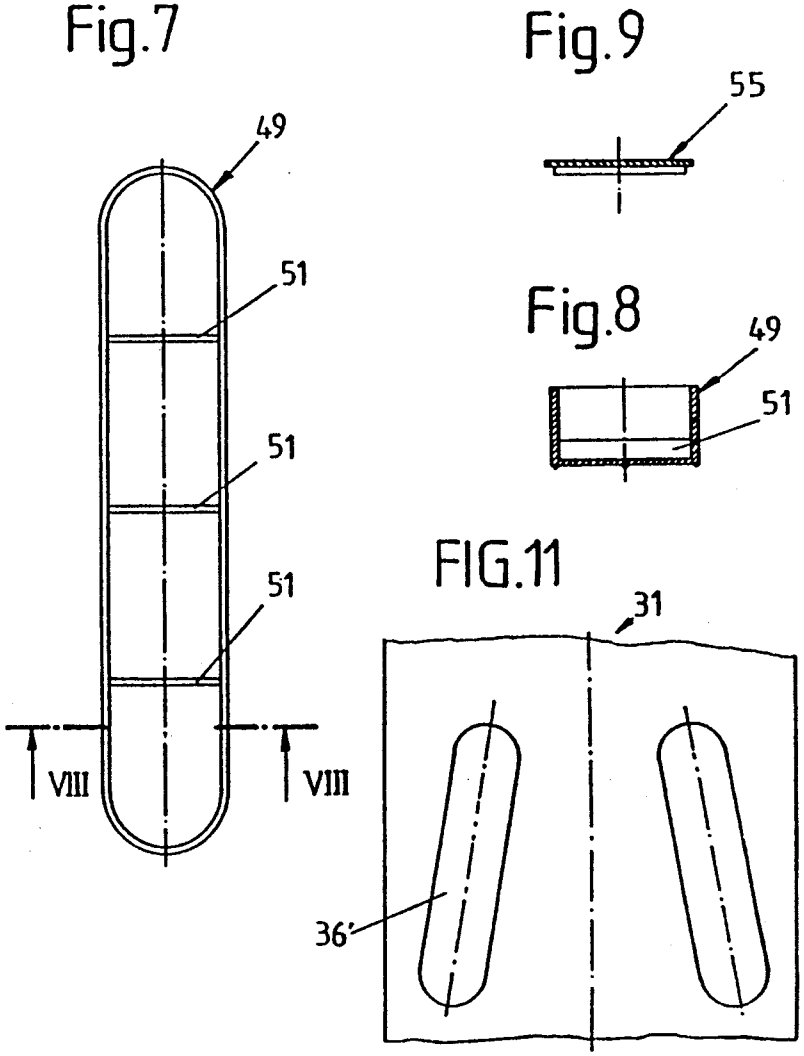
Fig.9
55
Fig.8
49
51
FIG.11
31
36'
Fig.7
49
51
51
51
VIII
VIII
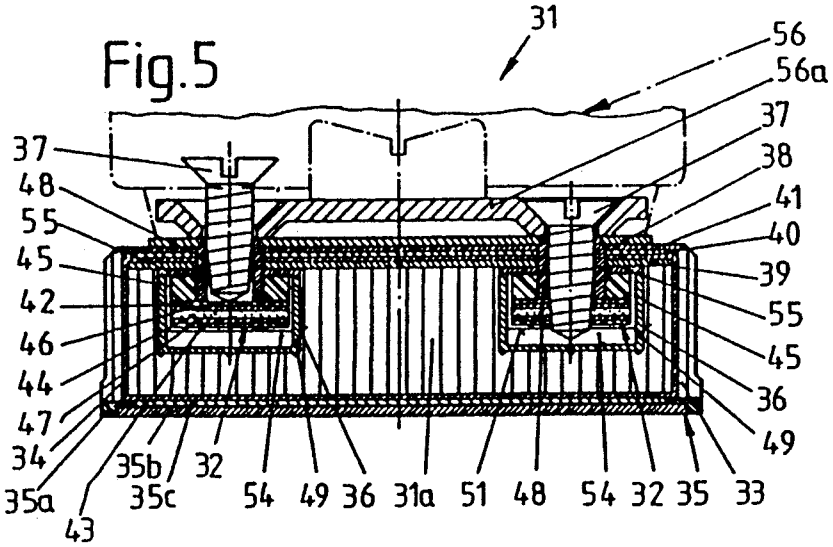
Fig.5
31
56
56a
37
38
41
40
39
55
45
36
49
33
35
32
54
48
51
31a
36
49
54
32
35b
35c
43
35a
34
47
44
46
42
45
55
48
37
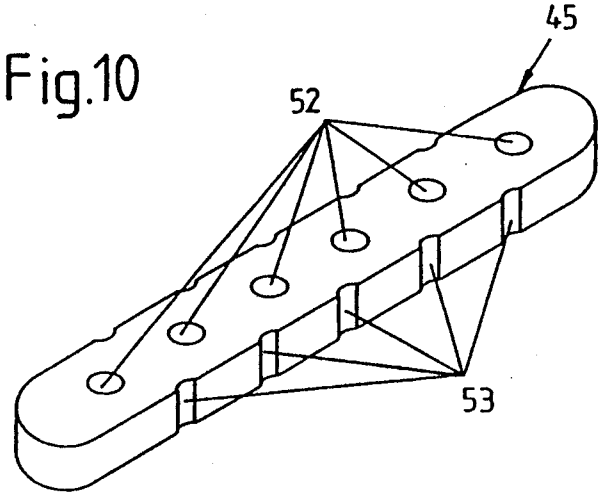
Fig.10
45
52
53

SKI

BACKGROUND OF THE INVENTION

Field of the Invention

The invention relates to a ski having a core, an upper and lower cover layer and grooves disposed in the core.

Similar type of ski is already described in Swiss Patent Specification 575,768. This ski had the disadvantage that, during skiing, sometimes the screws became loose and were lost due to the vibrations thereby occurring. In addition, the connection of ski binding and ski lacked a certain flexibility, especially as the ski binding could no longer execute any relative movement perpendicularly to the ski upper side after the tightening of the fastening screws on the strip-shaped receiving parts of an aluminum alloy.

Another ski is disclosed in Austrian Patent Specification 288,929. In the case of this ski, a plurality of vertically running bores, into which the threaded bushes which form the receiving parts are inserted, are recessed in the core. The bores are covered at their upper end by the ski upper chord and can only be recognized from the outside by markings.

This ski is complicated in its design in as much as separate bores for each boot size have to be produced during its manufacture and separate threaded bushes have to be inserted, of which however as a rule only two pairs are actually used.

In German Patent Specification 586,946, a ski is described on which nuts into which the screws for fastening the ski binding are screwed are pressed into the core surrounded by synthetic resin.

This solution has the disadvantage that the binding can only be fastened at certain points on the ski, or that the pressing-in of the nuts has to be performed according to a stencil which is adapted to the binding to be fitted. In addition, the flexibility of the ski may be adversely affected by the binding rigidly fastened on the ski.

Furthermore, a ski produced from plastic, into which a metal plate is embedded which has open slits on its two longitudinal edges and therefore—considered in plan view—runs approximately meander-shaped, has been proposed in Austrian Patent Specification 214,326. Since the screws for fastening the binding can only be screwed into the slits of the metal plate, the load-bearing capacity of these screws is very limited. Moreover, in the case of this design there is also a certain stiffening of the ski due to the fitted binding.

In German Offenlegungsschrift 2,752,206, a solution is specified in which the ski binding is supported on the ski by intermediate liners of flexible material, which intermediate liners enclose the screws. In the case of this solution, although a stiffening of the ski by the fitted ski binding is largely avoided, the screws have to be screwed directly into the ski. As a result, however, the tear-out resistance of the screws is reduced, in particular in the case of skis without metal upper chord. In addition, here the intermediate liners of flexible material are exposed to environmental effects, which reduce their service life.

The invention sets itself the object of eliminating the disadvantages of the known solutions and creating a ski on which the screws for the fastening of the binding are securely anchored with their ends in the ski even after prolonged, but at the same time ensure a certain flexibility of the fastening of the binding with respect to the ski.

Summary of the Invention

According to the invention, a secure, flexible and vibration-damping anchorage of the fastening screws is provided in the ski, and consequently a flexible bearing of the binding inside the ski and relative to its upper side, is ensured.

With a ski according to the present invention, lateral impacts can also be absorbed or damped by the receiving part, which is firmly connected to the ski binding.

The invention also prevents a stiffening of the ski by the base plate of the binding in the case of the vibrations occurring during skiing.

In addition, the invention ensures that the fastening screws pass through both metal layers.

The invention also ensures that the base plate of the ski binding is held at a small distance from the upper side of the ski, which makes possible a relative movement of the two parts towards each other.

According to the invention, an all-sided damping of the movement of the ski binding with respect to the ski is made possible in a simple way.

The features of the present invention also prevent an ingress of water, snow and ice into the intermediate space between the upper side of the ski and the base plate of the ski binding.

With the invention, the installation of the receiving parts into the ski is simplified, the anchorage is improved, and the deformability of the flexible layer is increased.

In addition, one feature of the invention fixes the smallest distance of the base plate of the ski binding with respect to the receiving part, and a flexible bearing of the ski binding in each direction is ensured.

According to the invention, a free space for the ends of the fastening screws emerging from the receiving part is created. In addition, the rigidity of the receptacle is increased by these features, which is of significance in particular in the production of the ski.

Further, prevents the ingress of adhesive into the receptacle during the production of the ski.

Additionally, the present invention makes possible the fastening of ski bindings on which the spacings of the front and rear fastening screws—considered in transverse direction to the ski longitudinal axis—differ in size.

Finally, the invention is favorable for other manufacturing reasons. For example, the receptacles and the receiving parts may optionally be arranged in ski longitudinal direction or in ski transverse direction, the fastening screws then being screwed in pairs into one insert each.

BRIEF DESCRIPTION OF THE DRAWINGS

Embodiments of the ski according to the invention are represented by way of example in the drawings.

FIG. 5 is a cross sectional view of a ski in accordance with a third embodiment of the invention;

FIG. 7 is a plan viewing of the receptacle shown in FIG. 5;

FIG. 8 is a cross-sectional view taken along line VIII—VIII in FIG. 7;

FIG. 9 is a cross-sectional view of the cover of shown in FIG. 5;

FIG. 10 is a perspective view of the layer of elastomeric material shown in FIG. 5; and FIG. 11 is a top view of a variant of a ski in accordance with the present invention.

DESCRIPTION OF THE PREFERRED EMBODIMENTS

Figure 1:
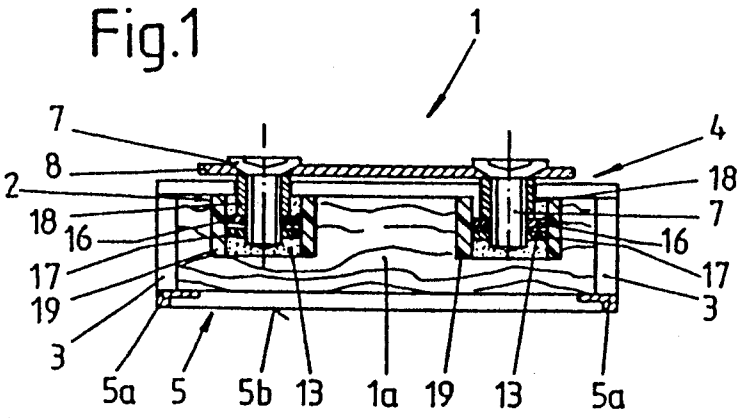
FIG. 1 is a cross sectional view of a ski in accordance with a first embodiment of the present invention.
Figure 2:
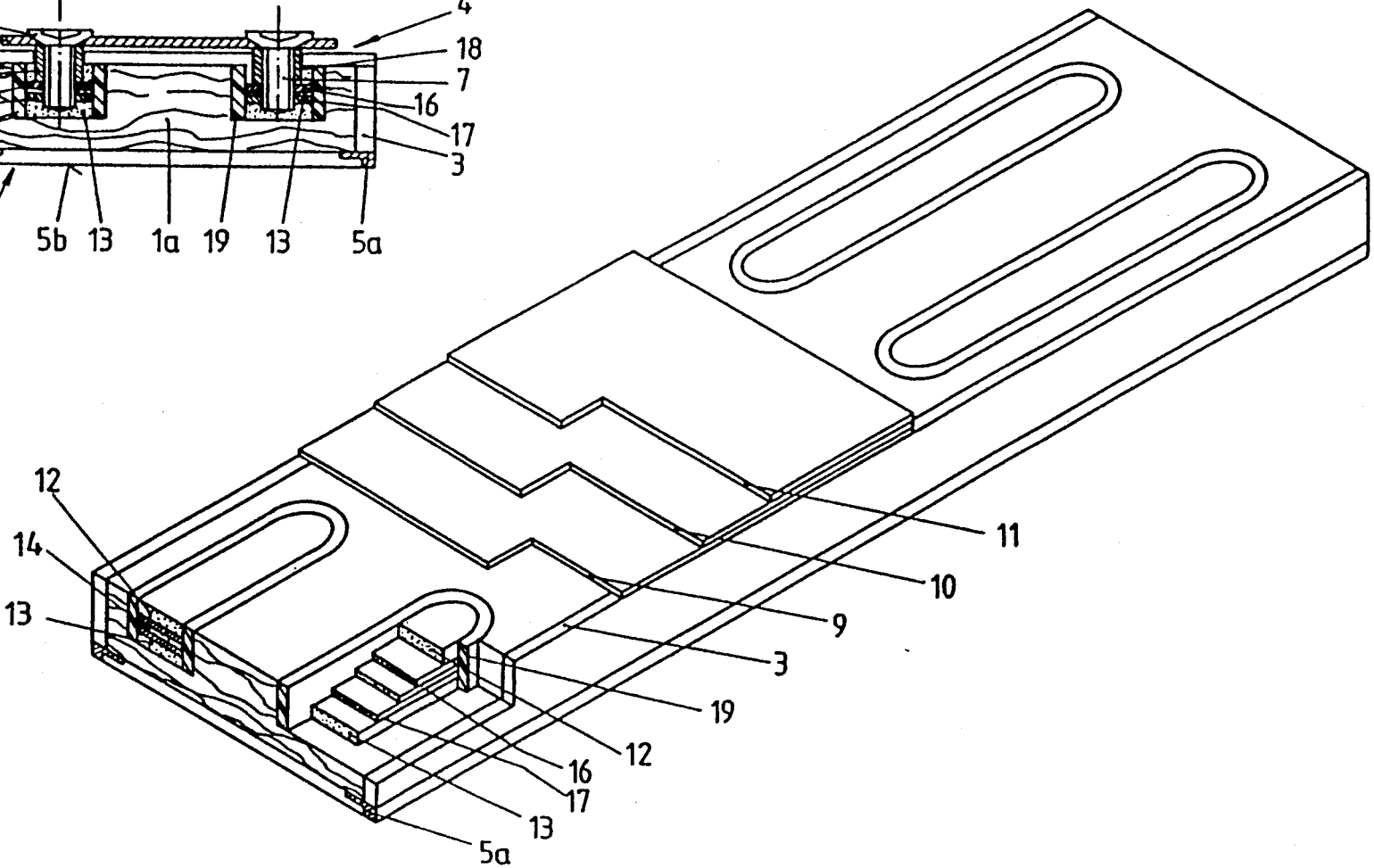
FIG. 2 is a cut away perspective view of the ski of FIG. 1.

In the case of the embodiment according to FIGS. 1 and 2, strip-shaped receiving parts 2 are inserted into the core 1*a* of a ski 1 in grooves 6 in each case and are connected to the core 1*a*, e.g. by adhesion or vulcanizing. In this case, a separate receiving part 2 is provided for each screw 7 for the fastening of the base plate 8.

The core 1*a* of the ski 1 is surrounded by an upper chord 4, which, as can be seen from FIG. 2, is formed from an aluminum layer 9, a glass fiber reinforced laminate 10 and a surface coating 11, a lower chord 5, which is usually formed from an aluminum layer, which is bounded laterally by the steel edges 5*a*, and a running coating 5*b*, as well as the two side cheeks 3. In this case, the receiving parts 2, as evident from FIG. 1, are covered by the upper chord.

In the case of the exemplary embodiment represented in FIGS. 1 and 2, the receiving parts 2 are built up in five layers. In this case, the uppermost and the lowermost layer 12 and 13, respectively, are produced from an elastomeric material, such as e.g. rubber or silicone rubber, as is the middle layer 14. These layers 12, 13, 14 are separated from one another by two layers 16, 17 of metal, in particular of an aluminum alloy.

The fastening screws 7 pass through the two aluminum layers 16, 17. On the upper aluminum layer 16 there rests a spacer sleeve 18, which passes through the upper layer 12 of an elastomeric material and the upper chord 4, the latter with play, and protrudes by a small amount beyond the upper side of the latter. On these spacer sleeves 18 lies the base plate 8; it is kept by the spacer sleeves 18 at a small distance from the upper side of the ski. In this case, each fastening screw 7 runs within the spacer sleeve 18 with its smooth shank, in order to make a relative movement possible.

The receiving parts 2 are surrounded by an intermediate liner 19, one each surrounding their side walls, of an elastomeric material, which fills the space between the side walls of the groove 6 and of the receiving part 2. In this case, the intermediate liner 19 may be bonded both to the side walls of the groove 6 and also to the receiving part 2 by adhesion or vulcanizing.

By the intermediate liners 19 and the elastomeric layers in the receiving parts 2, a mutual displacement of the base plate 8 and of the ski is made possible, as a result of which a stiffening of the ski 1 by the fitting of the base plate 8 is avoided and also a transfer of vibrations from the ski to the binding is largely damped.

Figure 3:
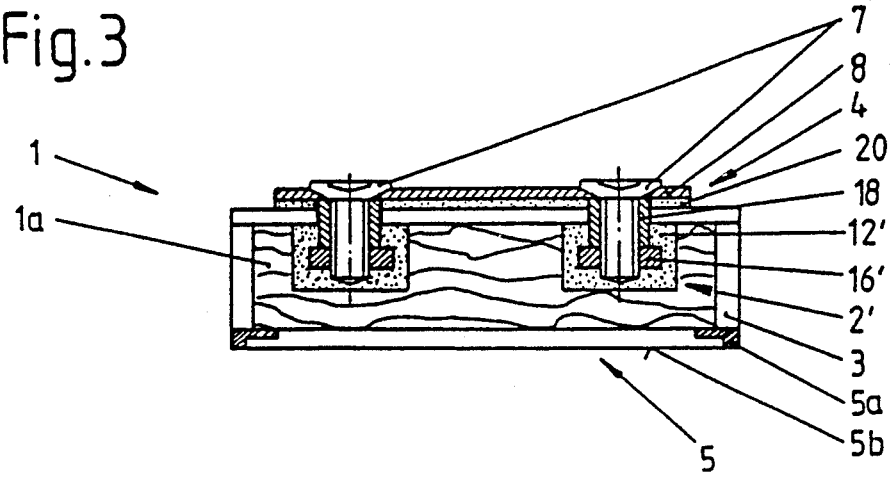
FIG. 3 is a cross sectional view of a ski in accordance with a second embodiment of the present invention.
Figure 4:
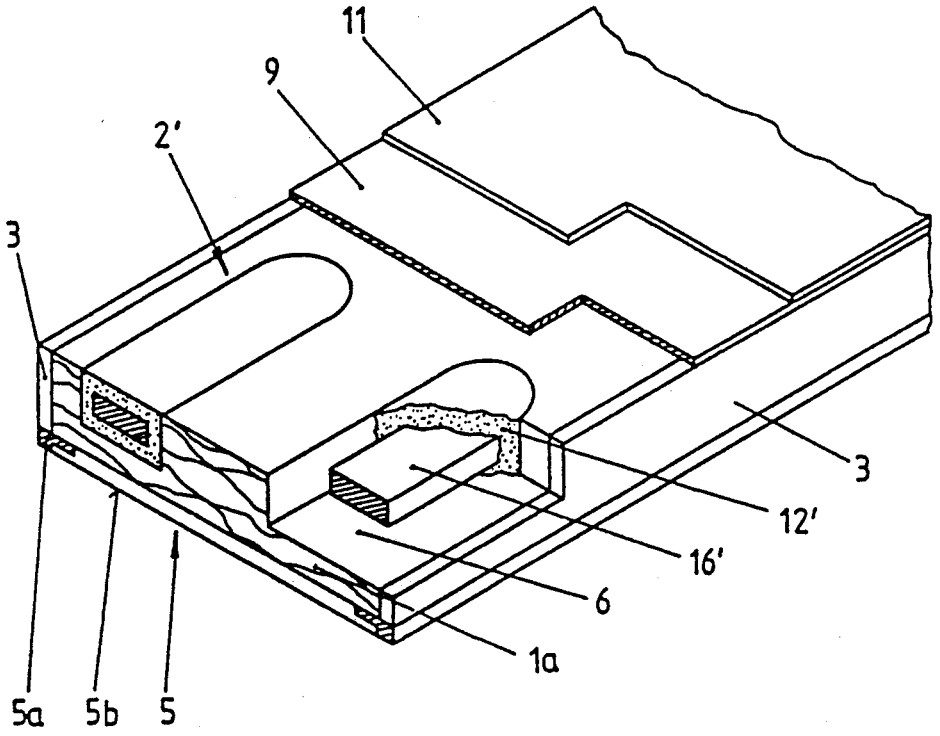
FIG. 4 a cut away perspective view of the ski of FIG. 3.

The embodiment according to FIGS. 3 and 4 differs from that according to FIGS. 1 and 2 in that each receiving part 2' has a metal layer 16', which is sheathed on all sides by an elastomeric material 12', such as e.g. rubber or silicone rubber.

The receiving parts 2' extend, as also in the case of the exemplary embodiment according to FIGS. 1 and 2, in longitudinal direction of the ski 1 in the region of the zones provided for the fastening of the binding, as a result of which an adaptation of the binding in longitudinal direction of the ski becomes possible.

In the case of the embodiment according to FIGS. 3 and 4, a layer 20 of sponge rubber is inserted between the upper side of the ski 1 and the base plate 8, which layer prevents the ingress of water, snow and ice into this intermediate space, which could impair the mutual mobility of the base plate 8 with respect to the ski 1.

Figure 6:
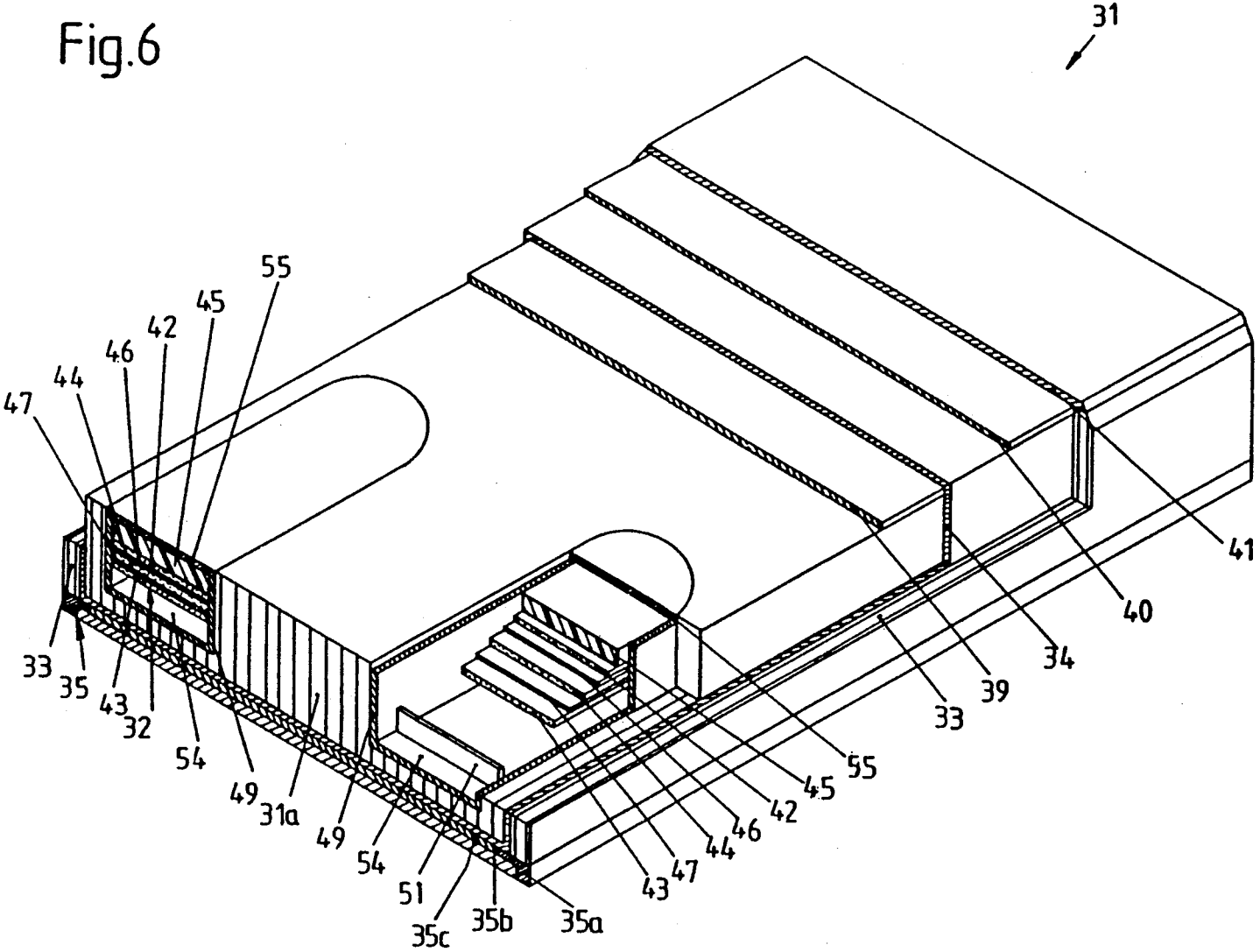
FIG. 6 an is a cut away perspective view of the ski of FIG. 5.

According to FIGS. 5 and 6, the ski 31 consists of a core 31*a*, which is covered on its upper side by a metal layer 39 and is surrounded over its entire circumference together with the metal layer by a torsion box 34. On the underside, the torsion box 34 is covered by a lower chord 35, which consists of a running coating 35*b* and of a metal layer 35*c*, which are embraced laterally by steel edges 35*a*. Laterally, side cheeks 33 are attached on the torsion box 34. On the upper side of the torsion box 34 lies an upper chord 40, which is covered by a surface coating 41. The design of such a ski 31 is known per se and does not form a subject of the invention.

In the core 31*a*, two upwardly open grooves 36 are recessed, into which receptacles 49 are inserted, which are likewise upwardly open and are firmly bonded, for example adhesively bonded, to the core 31*a*. Into each receptacle 49 there is inserted a receiving part 32, which is made up of a plurality of layers 42–47. This receiving part 32 serves to receive the fastening screws 37 of a ski binding 56, only indicated.

Each receiving part 32 consists of—considered from top to bottom—a layer 45 of rubber or the like, of a first layer 42 of glass fiber reinforced plastic, of an aluminum plate 46, of a second layer 44 of glass fiber reinforced plastic, of a further aluminum plate 47 and of a third layer 43 of glass fiber reinforced plastic. The individual layers 42–44 and the plates 46, 47 are bonded to one another, e.g. by adhesion, and form a block. The uppermost layer of the receiving part 32, namely the layer 45 of rubber or the like, is provided with a row of vertical holes 52 or of recesses, extending in longitudinal direction of the ski 31. Furthermore, vertically running grooves 53 are recessed in the longitudinal sides of the layer 45 (see FIG. 10).

Each receptacle 49 has, in plan view, the form of a rectangle, the shorter sides of which are replaced by semicircles (see FIG. 7). Between the two longitudinal side walls of the receptacle 49 there extend ribs 51, running in transverse direction, which are also firmly connected to the bottom and the height of which corresponds approximately to one third of the height of the receptacle 49. These ribs 51 serve to support the receiving part 32, which rests with its lowermost layer 43 on the ribs 51. At its upper side, the receptacle 49 is closed off by means of a cover 55.

In order to fix the smallest distance of the base plate 56*a* of the ski binding 56 relative to the plate layers 46, 47, bushes 48 are provided, which pass through both the layer 45 of elastomeric material and also the cover 55 with play and which lie with their lower ends on the block, which is formed by the layers 42 to 44, 46 and 47. The bushes 48 are riveted to a bush plate 38, which lies on the ski upper side.

According to FIG. 5, the ski binding 56 is fastened on the ski 31 by means of its base plate 56*a* by screws 37, which pass through the bush plate 38 and the bushes 48 with their smooth shanks. In this case, the screw 37 represented on the left in this Figure is represented directly after the insertion into the bush 48 and the right screw 37 is represented after the tightening of the ski binding 56. It also emerges from the Figure that, in the tightened state, although the screw 37 passes through all layers 42–47 of the receiving part 32, it protrudes with its end into the intermediate space between two ribs 51, which consequently forms a free space 54. A damaging of the bottom of the receptacle 49 by the screws 37 therefore does not take place.

In the case of the variant according to FIG. 11, the longitudinal axes of the two grooves 36' are arranged at an angle to the vertical longitudinal center plane of the ski 31. As a result, it is ensured that also ski bindings on which the forward and rear receiving locations of the fastening screws are provided in pairs with different spacings can be fastened. This development can be used in particular in the case of hire-ski bindings, on which the base plates are fixed—with respect to the length of the ski—from the outset.

The invention is not bound to the exemplary embodiments represented in the drawing and described above. Rather, various modifications of the same are possible without departing from the scope of the invention. For example, the receptacle may also be provided with more than three ribs. Also, the development according to the invention of the receiving part may be used in conjunction with a differently shaped ski. Furthermore, according to the invention it is possible, instead of two grooves, to recess three or more grooves, which are offset—seen in ski longitudinal direction and/or in ski transverse direction. Such grooves may also be arranged in alignment. In this way, ski bindings with different screw arrangements can be fixed on the ski. Furthermore, it is possible to fill the space above the bottom of the receptacle with elastomeric rubber to about one third of the receptacle height and to dispense with the arrangement of ribs.

The recesses provided to improve the deformability of the flexible layer may have a hemispherical shape or be designed as blind bores. It is, however, also possible, instead of recesses, to produce the entire flexible layer of a porous rubber material, e.g. of sponge rubber.

What is claimed is:

1. A ski, comprising:

at least one lower cover;

at least one upper cover;

a core disposed between said at least one upper cover and said at least one lower cover, said core including recessed grooves in a side thereof proximate said upper cover;

strip-shaped receiving parts disposed in said grooves, said receiving parts including at least two layers, one of said at least two layers including metal, and the other of said at least two layers including an elastomeric material; and spacer sleeves extending through said elastomeric material layer and including distal ends which extend beyond said at least one upper cover, said distal ends for bearing a base plate thereon and said spacer sleeves for receiving fastening screws to connect the base plate with the receiving parts.

2. The ski according to claim 1, wherein said grooves have side walls, the ski further including flexible intermediate liners disposed between said side walls of said grooves and said receiving parts.

3. The ski according to claim 1, wherein each of said receiving parts comprises five layers including two outermost layers and a middle layer being made of an elastomeric material, and two intermediate layers being made of metal, each intermediate layer being disposed between the middle layer and an outermost layer.

4. The ski according to claim 1, wherein each of said receiving parts comprises five layers including two outermost layers and a middle layer being made of a glass fiber reinforced plastic and wherein each receiving part is covered with a layer of elastomeric material.

5. The ski according to claim 1 wherein said spacer sleeves have second ends opposite said distal ends thereof, and wherein said second ends are supported by said metal layer of said receiving parts.

6. The ski according to claim 1 wherein the metal layer of the receiving part is surrounded on all sides by a sheath of elastomeric material.

7. The ski according to claim 1 further including a film of sponge rubber disposed proximate said at least one upper cover layer.

8. The ski binding of claim 1 further including an upwardly open plastic receptacle disposed in each groove.

9. A ski according to claim 8 further including a bush plate disposed on an upper side of the ski and having bushes fastened therein, said bushes passing through said at least one upper cover and a layer of elastomeric material of said receiving part, the bushes extending from the receiving part to a bottom surface of the base plate.

10. A ski according to claim 8, wherein the receptacle includes at least two upwardly protruding ribs disposed on a bottom end thereof, said ribs extending in a direction transverse to a longitudinal axis of the ski, said ribs including free upper edge for supporting the receiving part.

11. A ski according to claim 9, wherein said receptacle includes a cover disposed against a layer of elastomeric material of said receiving part, said cover including openings through which said bushes extend.

12. A ski according to claim 8, wherein the ski includes a longitudinal axis and each groove includes a longitudinal axis, said longitudinal axes of the grooves conveying with respect to the longitudinal axis of the ski.

13. A ski according to claim 8, wherein each of the grooves constitutes a separate unit with a corresponding receptacle and receiving part disposed therein.

14. The ski according to claim 3, wherein said intermediate layer includes glass fiber reinforced plastic.

15. The ski according to claim 1, wherein said at least one layer of elastomeric material is a plurality of layers of elastomeric material and wherein an uppermost layer of elastomeric material includes side walls having a series of vertical grooves disposed therein.

16. The ski according to claim 1 wherein an uppermost layer of said at least two layers of said receiving part is made of sponge rubber.

17. A ski, comprising:

at least one lower cover;

at least one upper cover;

a core disposed between said at least one upper cover and said at least one lower cover, said core including recessed grooves in a side thereof proximate said upper cover;

strip-shaped receiving parts disposed in said grooves, said receiving parts including at least two layers, one of said at least two layers including metal, and the other of said at least two layers including an elastomeric material;

a base plate;

spacer sleeves extending through said elastomeric material layer and including distal ends which extend beyond said at least one upper cover, said distal ends for bearing said base plate thereon; and fastening screws for connecting said base plate with said receiving parts.

* * * * *